US008496496B2

(12) United States Patent
Yan

(10) Patent No.: US 8,496,496 B2
(45) Date of Patent: Jul. 30, 2013

(54) PLUG AND CONNECTOR SYSTEM

(75) Inventor: Yu-Cyuan Yan, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/327,494

(22) Filed: Dec. 15, 2011

(65) Prior Publication Data

US 2013/0005170 A1 Jan. 3, 2013

(30) Foreign Application Priority Data

Jun. 30, 2011 (TW) ..... 100122989

(51) Int. Cl.
*H01R 13/627* (2006.01)

(52) U.S. Cl.
USPC ..... 439/353; 439/345

(58) Field of Classification Search
USPC ..... 439/247, 248, 345, 347, 350–353
See application file for complete search history.

(56) References Cited

U.S. PATENT DOCUMENTS

| | | | | |
|---|---|---|---|---|
| 2,410,618 | A * | 11/1946 | Zelov | 439/97 |
| 5,993,240 | A * | 11/1999 | Schaefer | 439/359 |
| 6,146,210 | A * | 11/2000 | Cha et al. | 439/680 |
| 6,758,688 | B2 * | 7/2004 | Chen | 439/135 |
| 6,817,884 | B1 * | 11/2004 | Chen et al. | 439/358 |
| 6,945,666 | B2 * | 9/2005 | Woolfson | 362/183 |
| 7,104,814 | B1 * | 9/2006 | She et al. | 439/131 |
| 8,357,005 | B2 * | 1/2013 | Hu | 439/353 |

* cited by examiner

*Primary Examiner* — Thanh Tam Le
(74) *Attorney, Agent, or Firm* — Altis Law Group, Inc.

(57) ABSTRACT

A connector system includes a socket and a plug. The socket includes a receptacle and a recess communicating with the receptacle. The plug includes a main body, a locking element and a spring. The main body is inserted in the receptacle to electrically connect the plug with the socket. The locking element is retractably mounted to the main body. The spring drives the locking element to be latched in the recess. When the pressing block is pressed, the resisting panel drives the latching block releasing from the recess.

13 Claims, 2 Drawing Sheets

PLUG AND CONNECTOR SYSTEM

BACKGROUND

1. Technical Field

This disclosure relates to plugs and connector systems using the plugs, particularly to a plug with a locking fastener.

2. Description of Related Art

The technology in consumer electronics, such as digital camera, DV camcorder, for example, advances each day. What remains unchanged is the pursuit of compact size, large capacity and fast transmission speed. Data or power transmission between different information equipment relies on connection interfaces, for example, USB interface. As regular connection interfaces are connected by wires or cables, in an occasion full of computer equipment like office, studio and so on, connection cables distributed among computer equipment can be easily pulled and dragged by passers-by to make the cables disconnect from the computer equipment and further cause interrupt to transmission. Such interrupt certainly results in inconvenience and data loss in operation, and sometimes damage the connected equipment.

Therefore, there is a room for improved in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the exemplary plug and connector system using the plug. Moreover, in the drawings like reference numerals designate their respective parts throughout the several views. Wherever possible, the same reference numbers are used throughout the drawings to refer to the same or like elements of an embodiment.

DETAILED DESCRIPTION

Figure 1:
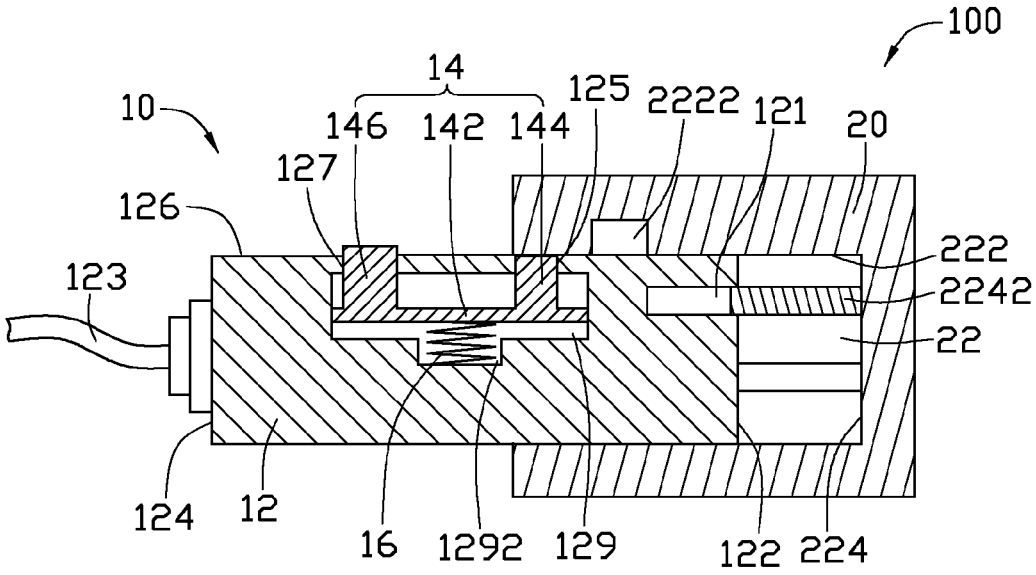
FIG. 1 is a cross-sectional view of an exemplary embodiment of a connector system, showing a plug being partially inserted in a socket.

Referring to FIG. 1, an exemplary embodiment of a connector system 100 includes a plug 10 and a socket 20. The plug 10 includes a main body 12 and a locking fastener including a locking element 14 and a spring 16 sandwiched between the main body 12 and the locking element 14. The locking element 14 and the spring 16 act as a locking assembly to stably lock the plug 10 in the socket 20 to enable the plug 10 to remain electrically connected with the socket 20.

The main body 12 includes a first end 122, a second end 124, a peripheral surface 126 connecting the first end 122 with the second end 124, a transmission cable 123 fixed to the second end 124. The main body 12 defines a plug hole 121 in the first end 122. The plug hole 121 may be a USB interface. The main body 12 further defines a first hole 125 and a second hole 127 spaced apart in the peripheral surface 126, and defines a space 129 under the first hole 125 and the second hole 127. The space 129 communicates with the first hole 125 and the second hole 127. The space 129 accommodates the locking element 14 and the spring 16. The first hole 125 and the second hole 127 is for the locking element 14 to partially extend out of the main body 12. Furthermore, to firmly sandwich the spring 16 between the locking element 14 and the main body 12, the main body 12 further defines a retaining hole 1292 communicating with the space 129 for accommodating the spring 16.

The locking element 14 includes a resisting panel 142, a latching block 144 and a pressing block 146, the latching block 144 and the pressing block 146 both protruding from the resisting panel 142. The resisting panel 142 is slidably accommodated in the space 129 and resists the spring 16 so the latching block 144 and the pressing block 146 are retractably fixed to the main body 12. The latching block 144 is slidably inserted in the first hole 125, the pressing block 146 is slidably inserted in the second hole 127.

The socket 20 defines a receptacle 22 and a recess 2222 communicating with the receptacle 22. The receptacle 22 accommodates the plug 10. The recess 2222 is latched with the latching block 144 to latch the plug 10 in the receptacle 22. In this embodiment, the receptacle 22 is enclosed by a plurality of sidewalls 222 and a bottom wall 224 connecting with the sidewalls 222. The recess 2222 is defined in one of the sidewalls 222. The bottom wall 224 protrudes a pin 2242 inserted in the plug hole 121 after the plug 10 is fully inserted in the receptacle 22 like shown in FIG. 2, the plug 10 is electrically connected to the socket 20.

The spring 16 provides an elastic force driving the latching block 144 and the pressing block 146 out of receptacle 22.

Figure 2:
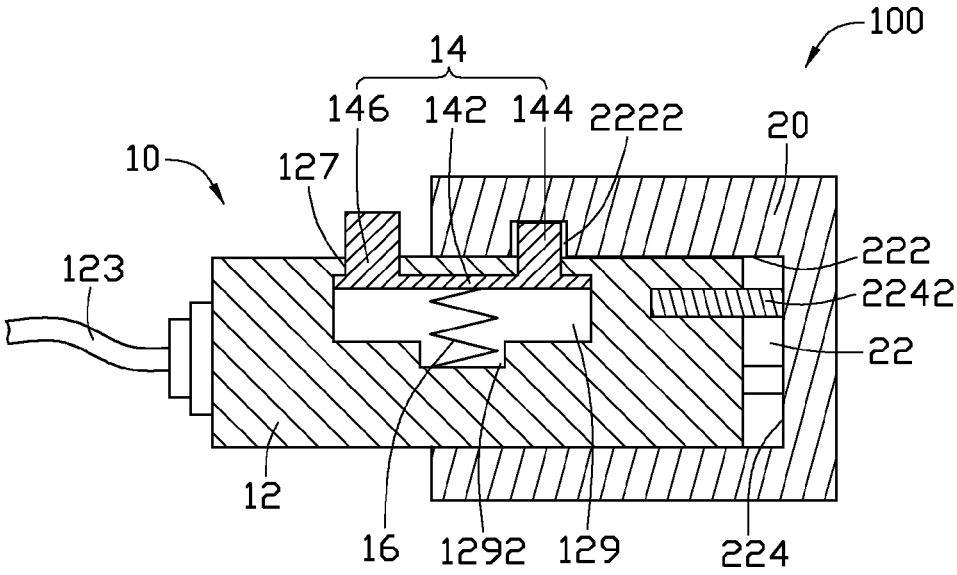
FIG. 2 is similar to FIG. 1, but showing the plug being fully inserted in the socket.

Referring to FIGS. 1 and 2, to insert the plug 10 to the socket 20, the pressing block 146 is pressed by a user to make the resisting panel 142 slide toward and compress the spring 16, until the latching block 144 is level with or lower than the peripheral surface 126. The plug 10 is inserted in the receptacle 22 until the pin 2242 is inserted in the plug hole 121 and the latching block 144 is aligned with the recess 2222. The pressing block 146 is released, the spring 16 drives the locking element 14 to slide in the space 129 until the resisting panel 142 resists the main body 12, at this time, the latching block 144 is inserted in the recess 2222 to prevent the plug 10 from coming out of the receptacle 22 accidentally.

To remove the plug 10 from the receptacle 22, the pressing block 146 is pressed by the user to make the resisting panel 142 slide toward and compress the spring 16, until the latching block 144 is level with or lower than the peripheral surface 126. At this time, the latching engagement between the recess 2222 and the latching block 144 is released, so the plug 10 can be smoothly pulled out of the receptacle 22.

It is to be further understood that even though numerous characteristics and advantages of the exemplary embodiments have been set forth in the foregoing description, together with details of structures and functions of various embodiments, the disclosure is illustrative only, and changes may be made in detail, especially in matters of shape, size, and arrangement of parts within the principles of the exemplary invention to the full extent indicated by the broad general meaning of the terms in which the appended claims are expressed.

What is claimed is:

1. A connector system comprising:

a socket including a receptacle and a recess communicating with the receptacle;

a plug including a main body, a locking element and a spring, the main body inserted in the receptacle to electrically connect the plug with the socket, the main body having a peripheral surface and defining a first hole, a second hole and an internal space, the first and second holes defined in the peripheral surface and spaced apart from each other and both communicated with the space, the locking element including a resisting panel, a pressing block and a latching block, the pressing block protruding from the resisting panel and slidably inserted in the second hole, the latching block protruding from the resisting panel and slidably inserted in the first hole, the resisting panel and the spring both slidably accommodated in the space, and the spring sandwiched between the resisting panel and the main body to drive the latching block to be latched in the recess;

wherein when the pressing block is pressed, the resisting panel slides toward and compresses the spring to retract the latching block from the recess.

2. The connector system of claim 1, wherein the socket has an internal protruding pin, and the main body further includes a plug hole accommodating the pin.

3. The connector system of claim 1, wherein the main body further defines a retaining hole communicating with the space, and the spring is retained in the retaining hole.

4. A connector system comprising:

a socket including a receptacle and a recess communicating with the receptacle;

a plug including a main body, the main body having a peripheral surface and defining a first hole, a second hole and an internal space, the first and second holes defined in the peripheral surface and spaced apart from each other and both communicated with the space, the main body slidably inserted in the receptacle for electrically connecting the plug with the socket along a first direction; and a locking assembly inserted in the first hole and the second hole and retractably received in the main body along a second direction perpendicular to the first direction, the locking assembly configured for elastically and partially locking in the recess when the plug is slidably inserted in the receptacle to be connected with the socket.

5. The connector system of claim 4, wherein the locking assembly comprises a locking element and a spring, the spring elastically sandwiched between the locking element and the main body.

6. The connector system of claim 5, wherein the locking element includes a resisting panel, a pressing block and a latching block, the pressing block and the latching block protrude from the resisting panel, the resisting panel and the spring are both slidably accommodated in the space, and the spring is sandwiched between the resisting panel and the main body.

7. The connector system of claim 6, wherein the socket has an internal protruding pin, and the main body further includes a plug hole in which the pin is accommodated.

8. The connector system of claim 7, wherein the latching block passes through the first hole.

9. The connector system of claim 7, wherein the pressing block passes through the second hole.

10. The connector system of claim 7, wherein the main body further defines a retaining hole communicating with the space, and the spring is retained in the retaining hole.

11. A plug inserted in a socket, the socket including a receptacle and a recess communicating with the receptacle, the plug comprising:

a main body having a peripheral surface and defining a first hole, a second hole and an internal space, the first and second holes defined in the peripheral surface and spaced apart from each other and both communicated with the space, the main body inserted in the receptacle to electrically connect the plug with the socket;

a locking element comprising a resisting panel, a pressing block and a latching block, the pressing block and the latching block protruding from the resisting panel, the latching block slidably inserted in the first hole, and the pressing block slidably inserted in the second hole; and a spring driving the locking element to be latched in the recess;

wherein when the pressing block is pressed, the resisting panel drives the latching block to be released from the recess and compress the spring.

12. The plug of claim 11, wherein the main body defines an internal space, the resisting panel and the spring are both slidably accommodated in the space, and the spring is sandwiched between the resisting panel and the main body.

13. The plug of claim 12, wherein the main body further defines a retaining hole communicating with the space, and the spring is retained in the retaining hole.

* * * * *